US010385413B2

(12) United States Patent
Crafton

(10) Patent No.: US 10,385,413 B2
(45) Date of Patent: Aug. 20, 2019

(54) SYSTEM AND METHOD FOR QUENCHING CASTINGS

(71) Applicant: Consolidated Engineering Company, Inc., Kennesaw, GA (US)

(72) Inventor: Scott P. Crafton, Marietta, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 15/922,939

(22) Filed: Mar. 16, 2018

(65) Prior Publication Data

US 2018/0202013 A1 Jul. 19, 2018

Related U.S. Application Data

(62) Division of application No. 14/855,498, filed on Sep. 16, 2015, now Pat. No. 9,951,396.

(60) Provisional application No. 62/052,279, filed on Sep. 18, 2014, provisional application No. 62/080,647, filed on Nov. 17, 2014.

(51) Int. Cl.

| | |
|---|---|
| ***C21D 1/04*** | (2006.01) |
| ***C21D 1/667*** | (2006.01) |
| ***C22F 1/04*** | (2006.01) |
| ***C21D 1/613*** | (2006.01) |
| ***C21D 1/60*** | (2006.01) |
| ***B22D 30/00*** | (2006.01) |
| ***C21D 11/00*** | (2006.01) |

(52) U.S. Cl.

CPC ..... *C21D 1/667* (2013.01); *B22D 30/00* (2013.01); *C21D 1/60* (2013.01); *C21D 1/613* (2013.01); *C21D 11/005* (2013.01); *C22F 1/04* (2013.01)

(58) Field of Classification Search

CPC ..... C21D 1/667; C21D 1/613; C21D 1/60; C22F 1/04

See application file for complete search history.

(56) References Cited

U.S. PATENT DOCUMENTS

| | | | |
|---|---|---|---|
| 2,390,238 | A | 2/1943 | Dean |
| 3,262,822 | A | 7/1966 | Griffith |
| 4,002,502 | A | 1/1977 | Bainbridge et al. |
| 5,112,412 | A | 5/1992 | Planta et al. |
| 5,529,645 | A | 6/1996 | Oswalt |
| 5,634,512 | A | 6/1997 | Bombardelli et al. |
| 5,788,784 | A | 8/1998 | Koppenhoefer et al. |
| 5,922,147 | A | 7/1999 | Valtierra-Gallardo et al. |
| 6,224,693 | B1 | 5/2001 | Garza-Ondarza et al. |
| 6,368,430 | B1 | 4/2002 | Bennon et al. |
| 6,752,885 | B1 | 6/2004 | Jerichow |
| 7,503,986 | B2 | 3/2009 | Kamat et al. |
| 8,168,015 | B2 | 5/2012 | Doty |
| 8,409,374 | B2 | 4/2013 | Lumley et al. |
| 8,447,574 | B2 | 5/2013 | Wang et al. |
| 8,636,855 | B2 | 1/2014 | Wang et al. |
| 8,758,529 | B2 | 6/2014 | Wang et al. |
| 2002/0129921 | A1 | 9/2002 | Frank et al. |
| 2007/0051443 | A1 | 3/2007 | Lukasak et al. |
| 2008/0011443 | A1 | 1/2008 | Craton et al. |
| 2010/0101691 | A1 | 4/2010 | Doty |
| 2010/0224289 | A1 | 9/2010 | Wang et al. |
| 2010/0224293 | A1 | 9/2010 | Wang et al. |
| 2011/0303385 | A1 | 12/2011 | Salina-Pena et al. |
| 2012/0041726 | A1 | 2/2012 | Wang et al. |

FOREIGN PATENT DOCUMENTS

| | | | |
|---|---|---|---|
| DE | 19909519 | A1 | 2/2000 |
| DE | 102011105447 | A1 | 12/2012 |
| DE | 102012017711 | A1 | 3/2013 |
| DE | 102011118463 | A1 | 5/2013 |
| EP | 0 699 242 | | 3/1996 |
| EP | 1 241 273 | | 11/2003 |
| JP | 02254141 | A | 3/1989 |
| JP | 2008248283 | A | 10/2008 |
| WO | WO 2014/068493 | A1 | 5/2014 |
| WO | WO 2014/068494 | A1 | 5/2014 |

OTHER PUBLICATIONS

Manente, Andrea and Timelli, Giulio, Optimizing the Heat Treatment Process of Cast Aluminium Alloys, Recent Trends in Processing and Degradation of Aluminium Alloys, Prof. Zaki Ahmad (Ed.), ISBN: 978-953-307-734-5, InTech, Available from: http://www.intechopen.com/books/recent-trends-in-processing-and-degradation-of-aluminium-alloys/optimitzing-the-heat-treatment-process-of-cast-aluminium-alloys, Nov. 2011, pp. 197-220, InTech, Rijeka, Croatia.

International Search Report & Written Opinion dated Nov. 24, 2015, from PCT Application No. PCT/US2015/050336.

Heat Treating of Aluminum Alloys—ASM Handbook, vol. 4: Heat Treating—pp. 841-879; Jan. 1, 1991.

Optimization of quench history of aluminum parts for superior mechnical properties—David D. Hall and Issam Mudawar—Int. J. Heat Mass Transfer, vol. 39, Jan. 1, 1996—pp. 81-95.

Jet-Impingement Furnace for the Solution Heat Treatment of Aluminum Castings—J. Mahoney, P. Shefsiek, Mar. 15, 2011, pp. 1-7.

Supplementary European Search Report dated Feb. 5, 2018 from co-pending European patent application No. 15842020.8.

*Primary Examiner* — Jessee R Roe

(74) *Attorney, Agent, or Firm* — Louis T. Isaf; Womble Bond Dickinson (US) LLP

(57) ABSTRACT

A quench system includes an enclosure defining a quench chamber sized to receive hot castings, and bulk air fans in fluid communication with the quench chamber and configured to establish a bulk flow of cooling air that surrounds and extracts heat from the hot castings at a first cooling rate. The quench system also includes a pressurized cooling system in fluid communication with a plurality of nozzles within the quench chamber and configured to spray a plurality of a directed flows of cooling fluid onto the hot castings to extract heat at a second cooling rate. The quench system further includes a programmable controller configured to sequentially activate the bulk air fans to cool the casting at the first cooling rate for a first predetermined period of time, and then activate the pressurized cooling system to cool the casting at the second cooling rate for a second predetermined period of time.

17 Claims, 5 Drawing Sheets

SYSTEM AND METHOD FOR QUENCHING CASTINGS

CROSS-REFERENCE TO RELATED APPLICATIONS

This application is a divisional of U.S. patent application Ser. No. 14/855,498, filed on Sep. 16, 2015, now U.S. Pat. No. 9,951,396; which application claims the benefit of U.S. Provisional Patent Application No. 62/052,279, filed on 18 Sep. 2014, and U.S. Provisional Patent Application No. 62/080,647, filed on 17 Nov. 2014, each of which is incorporated by reference in its entirety herein and for all purposes.

FIELD

The present invention relates generally to the quenching of metallic castings after heat treatment or initial removal from the mold or die, and more specifically to the quenching of die-cast thin-wall aluminum castings after solution treatment and prior to aging.

SUMMARY

Briefly described, one embodiment of the present disclosure comprises a quench system for cooling a hot casting through a quenching cycle. The quench system generally includes an enclosure that defines a quench chamber that is sized and shaped to receive one or more castings in a heated state. The quench system also includes one or more bulk air fans in fluid communication with the quench chamber and configured to establish a bulk flow of cooling air that surrounds and extracts heat from the hot castings at a first cooling rate. The quench system further includes a pressurizable cooling system in fluid communication with a plurality of nozzles within the quench chamber and configured to spray a plurality of a directed flows of cooling fluid onto the hot castings to extract heat from the castings at a second cooling rate. In some aspects the cooling fluid is a high pressure spray of cooling liquid, such as water, while in other aspects the cooling fluid is a high velocity stream of cooling air. The system further includes a programmable controller that is configured to sequentially activate the bulk air fans to cool the casting at the first cooling rate for a first predetermined period of time, and then deactivate the bulk air fans and activate the pressurizable cooling system to cool the casting at the second cooling rate for a second predetermined period of time.

Another embodiment of the disclosure includes a method for quenching a hot casting having an initial surface temperature ranging from about 450° C. to about 550° C. The method includes cooling the casting in a bulk air flow first stage quench to a first intermediate surface temperature ranging from about 275° C. to about 450° C., and within a first predetermined period of time ranging from about 10 seconds to about 50 seconds, followed by cooling the casting in a directed flow second stage quench to a second intermediate surface temperature that is less than about 175° C., and within a second predetermined period of time ranging from about 10 seconds to about 40 seconds. In some aspects the cooling fluid comprises a high pressure spray of cooling liquid, such as water, while in other aspects the directed flow comprises high velocity air. The method further includes cooling the casting in a third stage quench to a final quench surface temperature that is less than about 70° C., and within a third predetermined period of time that is less than about 30 seconds. In some aspects the third stage quench comprises a bulk air flow, while in other aspects the third stage quench comprises a plurality of directed air flows.

Yet another embodiment of the disclosure includes a method for quenching a hot casting having an initial surface temperature ranging from about 450° C. to about 650° C. and includes cooling in a first stage bulk air flow quench to a first intermediate surface temperature ranging from about 275° C. to about 450° C., and within a first predetermined period of time that is less than about 20 seconds. The method then includes cooling the casting in a second stage water spray quench to a second intermediate surface temperature that is less than about 125° C., and within a second predetermined period of time that is less than about 20 seconds. The method further includes cooling the casting in a third stage bulk air flow quench to a final quench surface temperature that is less than about 50° C., and within a third predetermined period of time that is less than about 20 seconds.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

The following description is provided as an enabling teaching of exemplary embodiments of a multi-stage system and method for quenching metallic castings. Those skilled in the relevant art will recognize that changes can be made to the embodiments described, while still obtaining the beneficial results. It will also be apparent that some of the desired benefits of the embodiments described can be obtained by selecting some of the features of the embodiments without utilizing other features. In other words, features from one embodiment or aspect may be combined with features from other embodiments or aspects in any appropriate combination. For example, any individual or collective features of method aspects or embodiments may be applied to apparatus, product or component aspects, or embodiments and vice versa. Accordingly, those who work in the art will recognize that many modifications and adaptations to the embodiments described are possible and may even be desirable in certain circumstances, and are a part of the invention. Thus, the following description is provided as an illustration of the principles of the embodiments and not in limitation thereof, since the scope of the invention is to be defined by the claims.

Illustrated in FIGS. 1-9 are several representative embodiments of a multi-stage quench system and method for quenching hot metallic castings, such as immediately after initial formation of the castings, or after solution heat treatment of the castings, or the like. As described in more detail below, the quench system and method can provide several significant advantages and benefits over other systems and methods for quenching metallic castings, such as improving the mechanical properties of the castings while substantially reducing both the quench time and the distortion of the castings. However, the recited advantages are not meant to be limiting in any way, as one skilled in the art will appreciate that other advantages may also be realized upon practicing the present disclosure.

Figure 1:
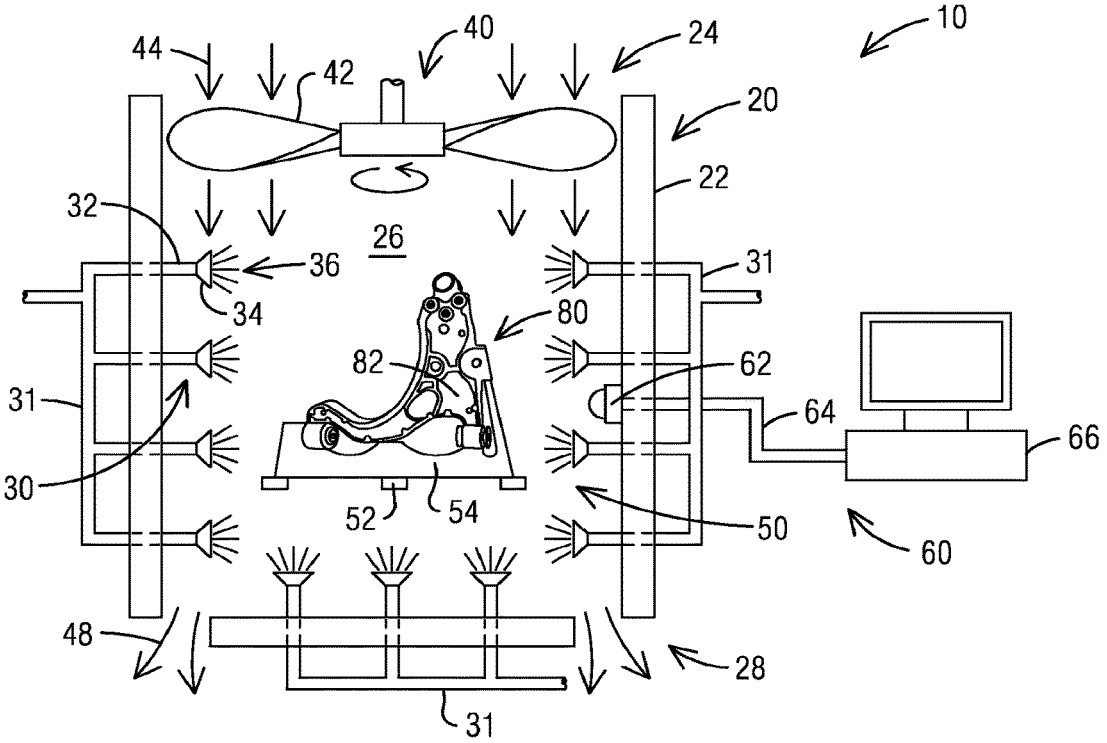
FIG. 1 is a schematic diagram of a multi-stage air/liquid quench system for quenching castings, in accordance with a representative embodiment of the disclosure.

In one embodiment of the present disclosure shown in FIG. 1, the multi-stage quench system 10 generally includes a housing 20 comprising an enclosure 22 that surrounds a quench chamber 26 within which one or more hot castings (represented in the drawings as a single casting 80) can be positioned or secured. In FIG. 1 the casting 80 is depicted as a control arm 82 for an automobile suspension system that has been formed from an aluminum alloy material through a high pressure die cast (HPDC) process. It will be appreciated, however, that control arm 82 is merely a representative casting part 80 for discussion purposes, and that the hot castings can also be shaped into a variety of parts (e.g. engine blocks, transmission housings, drive boxes, shock towers, pump housings, chassis frame components, suspension components, airframe components, and the like) for a range of industries (e.g. the automotive, rail, aircraft and marine transportation industries, as well as for mining, power generation, oil & gas production, and the like) that often require high-strength and dimensionally accurate metallic parts. In some aspects the casting 80 can include both thick-wall portions that provide the part with its required rigidity and strength, and thin-wall portions that serve to reduce the overall weight or material cost of the part without a substantial decrease in performance.

Furthermore, the hot casting 80 can be made from a wide variety of casting materials, including various aluminum alloys (being equal to or greater than 50% aluminum by weight) and non-aluminum alloys (being less than 50% aluminum by weight). In addition, the hot casting 80 can also be made through a variety of casting processes other than the HPDC process, including but not limited to low pressure die cast (LPDC), high vacuum die cast (HVDC), gravity die cast, and the like.

As shown in FIG. 1, in one aspect the hot casting 80 can be removably positioned or secured within the quench chamber 26 using a support system 50 that positions and orients the casting 80 during the quenching process. In one aspect the support system 50 can comprise a framework or fixture 54 that extends upward from a tray 52 to contact the casting at a few locations across its bottom surfaces and/or lower edges so as to loosely maintain the casting at a desired position and orientation within the quench chamber 26, but with both the fixture 54 and tray 52 otherwise being largely open or empty so to not block the flows of the various cooling fluids from reaching the casting. However, in other aspects the support system may comprise a full position fixture (not shown) that is tightly or with close tolerances clamped around the hot casting 80 after initial formation or heat treatment and that travels with the casting 80 during the quenching process, and which can rigidly constrain the casting during quenching so as to reduce or minimize distortions that could pull the metallic part out of dimensional tolerance. In yet other embodiments the casting 80 can be freely suspended within the quench chamber 26 (i.e. without underside support or clamping), such as from a riser or stub that was formed integral with the casting but that will not be removed from the part until after quenching is complete.

The multi-stage quench system 10 also generally includes a pressurized liquid spray cooling system 30 and a bulk air cooling system 40. The liquid spray cooling system 30 can include a source of pressurized cooling liquid in fluid communication with a plurality of nozzles 32 with nozzle heads 34 through one or more manifolds 31. The nozzles 32 are configured to spray the cooling liquid 36 onto the hot casting 80 during one or more portions of the quench cycle to provide a liquid spray quench. The cooling liquid 36 can generally comprise water or a mixture of water and one or more additional liquid components, such as glycol. In addition, the nozzle heads 34 can be configured to provide the cooling liquid 36 in a variety states, from high pressure/high velocity streams with large drops to atomized mists formed from droplets having an average size of less than or about 100 μm. In another aspect, the temperature of the cooling liquid 36 prior to dispersal from the nozzles may be maintained at a predetermined temperature that has been optimized to provide the desired cooling affects.

The nozzles 32 and nozzle heads 34 of the liquid spray cooling system 30 can be configurable in both direction and flow so as to provide precision control over the application of cooling liquid 36 onto the hot casting 80 for extracting heat therefrom. For example, the configuration of individual nozzles 32 and nozzle heads 34 may be customizable, either manually or by programmable actuation, to match a particular casting part, so as to increase the amount of cooling liquid 36 that is applied to the thicker portions of the casting 80 relative to the amount of cooling liquid that is applied to the thin-wall portions of the casting. Furthermore, the cooling liquid can be simultaneously applied to all sides or exposed surfaces of the casting 80 (i.e. front, back, sides, bottom, top, or internally). In this way the casting 80 may be cooled in a substantially uniform manner throughout the liquid spray cooling portion(s) of the quenching cycle. Because the relative temperatures of the various portions of the casting 80 can be maintained substantially equal throughout the quenching cycle, any thermally-induced internal stresses and the resulting dimension distortions of the casting 80 can be substantially reduced.

The bulk air cooling system 40 can include one or more rotatable cooling fans 42 that are configured to provide a bulk flow of cooling air 44 that enters the quench chamber 26 through an entrance 24, passes across and around exterior surfaces of the hot casting 80 to remove heat from the casting, and then exits the chamber 26 through one or more exits 28 as an exhaust flow 48. In one aspect the temperature and flow rate of the bulk cooling air 44 can be controlled to provide the desired cooling characteristics. For instance, the motors driving the rotatable cooling fans 42 can be powered by variable frequency drives (VFDs) that can provide a continuously variable bulk flow of cooling air across a wide range of operating speeds or frequencies. The bulk air cooling system 40 and the chamber 26 may also be configured to ensure that the cooling air 44 passes over substantially all of the exposed exterior surfaces of the casting 80 to cool the casting in a substantially uniform manner throughout the force air cooling portion(s) of the quenching cycle.

As understood by one of skill in the art, moreover, the configuration of the bulk air cooling system 40 depicted in FIG. 1 is merely illustrative of a generalized bulk air system that provides a stream of cooling air 44 that surrounds the casting 80. This is because the cooling fan 42 could be positioned above or below the chamber 26 or even remote from the chamber, and configured to draw or push the cooling air through the chamber and across the casting 80 from any direction. Indeed, as the heated exhaust air 48 could at times be mixed with steam from the liquid spray cooling system 30, it may be advantageous to draw the cooling air 44 into the chamber from below and discharge the mixed exhaust air 48 and heated water vapor through exits located in the upper portion of the chamber 26, in a direction opposite from that illustrated in FIG. 1.

The multi-stage quench system 10 also generally includes a programmable controller 66, such as a computer or similar electronic processor-based device, that is configured to activate and deactivate the bulk air cooling system 40 and the pressurized liquid spray cooling system 30. Thus, the controller 66 can be used to adjust the cooling provided by the liquid spray cooling system 30 and the bulk air cooling system 40 to ensure that each type of casting 80 can experience a specific, pre-programmed quenching process. In one aspect the controller 66 can also be used to automatically adjust the positioning and flow of liquid through individual nozzles 32, as described above. Alternatively, the quench system 10 may utilize a basic timer system wherein a set defined time schedule is used for sequentially activating and deactivating each of the cooling systems 30, 40.

Also shown in FIG. 1 is an optional temperature sensing system 60 that can measure and monitor the surface temperature of the casting 80 through the use of one or more temperature sensors 62. In one aspect the temperature sensors 62 can remotely measure the surface temperature of the casting 80 at one or more locations without contacting the surface, such as with an infrared sensor. In other aspects the one or more temperature sensors may be located directly on or within the casting part. Electrical communication can be established between the temperature sensors 62 and the programmable controller 66 through control wiring 64, with the programmable controller 66 being used to monitor and record the reduction in the surface temperature of the casting 80 as it undergoes the quenching process.

Once the hot casting 80 has been positioned or secured within the quench chamber 26, the bulk air cooling system 40 and the liquid spray cooling system 30 can be operated independently, or together, to rapidly quench the casting 80 using a predetermined sequence of quenching stages or steps. For example, one exemplary embodiment of utilizing the multi-stage quench system 10 of the present disclosure is expressed below, as might be applied to an aluminum alloy casting. In particular, the temperature vs. time graph of a representative process 100 for quenching the aluminum alloy casting 80 is provided in FIG. 2 (also known as a quench profile), in which the temperature 102 of the casting can be quickly and uniformly reduced in three or more distinct stages or phases that include alternating operation of the bulk air cooling system 40 and the liquid spray cooling system 30. As discussed above, this rapid yet controlled reduction of the temperature 102 of the casting 80 in a substantially uniform fashion can result in a high strength part with minimal dimensional distortions.

Figure 2:
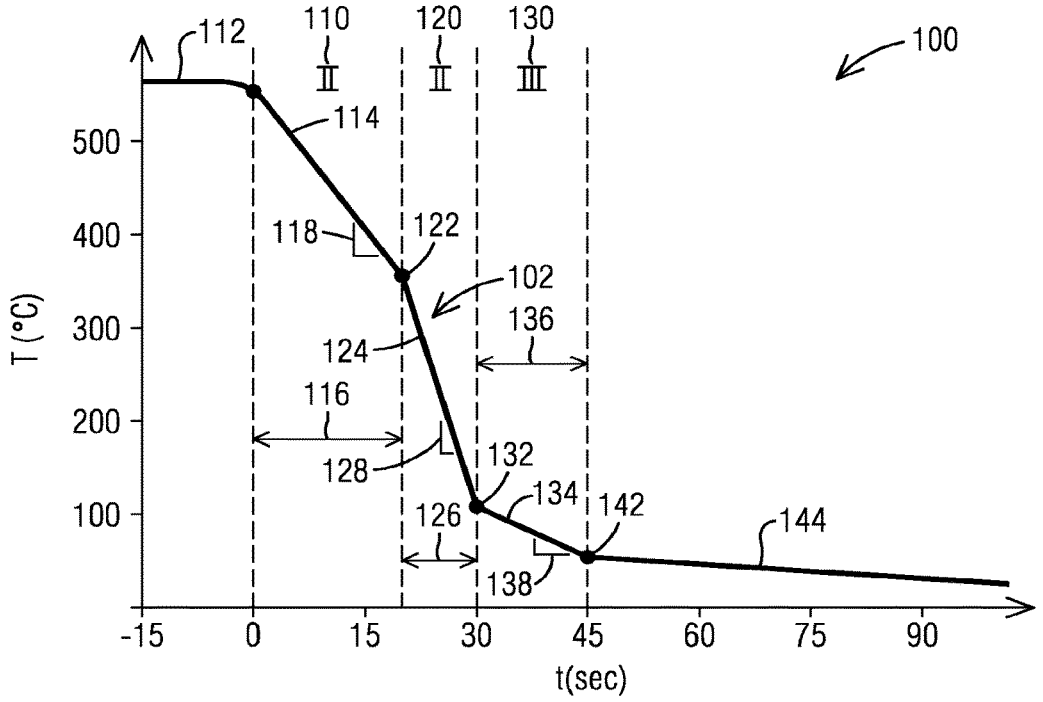
FIG. 2 is a graph representing the temperature change of a casting throughout a multi-stage quenching process, in accordance with another representative embodiment.

Prior to entering the first stage ("Stage I") 110 of the quenching process 100, the hot casting can be placed into the quench system at an initial temperature 112, such as an elevated post heat treatment temperature as the casting leaves a solution furnace. For aluminum-base alloys, for example, the initial temperature 112 can range from about 450° C. to about 650° C., and in one representative embodiment (FIG. 2) can be about 550° C. The bulk air cooling system 40 can then be activated to provide a Stage I bulk air quench 114 that cools the casting from the initial temperature 112 to a first intermediate temperature 122. Depending on the casting alloy and/or the thickness of the casting, the first intermediate temperature 122 can range from about 275° C. to about 450° C., and in the embodiment of FIG. 2 can be about 350° C. The Stage I bulk air quench 114 takes place during a Stage I time period 116 lasting between about 5 seconds and about 20 seconds. This can result in a Stage I cooling rate 118 ranging between about 10° C./sec and about 40° C./sec. In some aspects the Stage I cooling rate 118 can be substantially linear or constant (as also shown in FIG. 2), while in other aspects the Stage I cooling rate 118 may be non-linear or variable.

At the conclusion of the first stage 110 of the quenching process 100, the bulk air cooling system 40 can be deactivated and the liquid spray cooling system 30 activated to provide a second stage ("Stage II") 120 liquid (or liquid/air) spray quench 124 that further cools the casting from the first intermediate temperature 122 to a second intermediate temperature 132. The second intermediate temperature 132 can be about 150° C. or lower, and in the embodiment of FIG. 2 can be about 100° C. The Stage II 120 liquid spray quench 124 can have a time period 126 with a duration between about 5 seconds and about 20 seconds, resulting in a Stage II cooling rate 128 ranging between about 12.5° C./sec and about 50° C./sec. In some aspects the Stage II cooling rate 128 can be substantially constant, while in other aspects the Stage II cooling rate 128 may be variable.

After the casting temperature has reached the second intermediate temperature 132, the liquid spray cooling system 30 can be deactivated and the bulk air cooling system 40 reactivated to provide a third stage ("Stage III") 130 bulk air quench 134 that further cools the casting from the second intermediate temperature 132 to a final quench temperature 142 of about 70° C. or lower. In the embodiment of FIG. 2, final quench temperature 142 can be about 50° C. The Stage III 130 bulk air quench 134 can have a time period 136 lasting between about 5 seconds and about 10 seconds, resulting in a Stage III cooling rate 138 between about 5° C./sec and about 10° C./sec. In some aspects the Stage III cooling rate 138 can be substantially constant, while in other aspects the Stage III cooling rate 138 may be variable. When the Stage II 120 cooling liquid is water, the Stage III 130 bulk air can also function to dry any residual moisture that remains on the casting after the Stage II spray quench 124. After reaching the final quench temperature 142 of about 50°

C., the casting can be allowed to gradually cool 144 to ambient temperature for natural aging, or may be transferred to a secondary furnace for artificial aging at an elevated temperature, and for an extended period of time, before being allowed to cool naturally.

As discussed above, each of the air quench stages 114, 134 and the spray quench stage 124 can be configured to cool the casting in a substantially uniform manner throughout the quench steps to reduce the thermally-induced stresses that may develop within the part. This feature of the disclosure can function to minimize or substantially reduce the thermally-induced dimensional distortions that may otherwise be generated during the quenching processes, resulting in fewer castings that are rejected for falling outside of dimensional tolerances. In some embodiments the uniform quenching process may be combined with a support system 50 (FIG. 1) that includes close-tolerance bracing (not shown but known in the art) to further constrain the casting during quenching in a manner that resists any thermally-induced distortions.

The total time to perform the multi-stage quenching process 100 on a hot aluminum alloy casting, from the initial temperature 122 to the final quench temperature 142, can range from about 15 seconds to about 50 seconds. Although the multi-stage quenching process 100 can take longer than an immediate immersion quench in water or oil, as presently available in the art, the ability to variably control the cooling rate of the casting throughout the quenching process can result in a quenched casting with improved metallurgical properties and reduced dimensional distortions. In some aspects, moreover, it is contemplated that the multi-stage quenching process 100, when used to conclude a properly-optimized solution heat treatment process, can provide the resulting casting with such improved metallurgical properties that the additional step of artificially aging the casting at an elevated temperature in a secondary furnace may not be necessary to meet customer specifications.

It will be appreciated that the multi-stage quench system 10 and quenching process 100 illustrated in FIGS. 1-2 is a batch-based or cell-based quench system in which each stage in quenching process is performed at the same location on a casting that can be substantially fixed in space, or at least within the chamber 26 of the enclosure 20. However, it is also possible or even likely that mass produced castings will undergo the multi-stage quenching process 100 while moving through a continuous process quench system such as, for example, the quench system 200 illustrated in FIG. 3.

The multi-stage quench system 200 generally includes an elongated enclosure 202 that defines a quench chamber 206, with multiple castings (not shown) traveling through the chamber 206 at a substantially constant speed 201 from an entrance opening 204 at one end of the enclosure 202 to an exit opening 208 at the opposite end. The enclosure 202 can include a first section 210 having a bulk air cooling system 212 that provides a Stage I air quench 114 (FIG. 2). Depending on the speed 201 at which the castings travel through the enclosure 202, the first bulk air cooling system 212 may include one or more cooling fans 214 that provide a bulk flow of cooling air through the chamber 206. In one aspect the cooling fans 214 can be provided with VFD drives so that bulk flow of cooling air is continuously variable across a wide range of operating speeds, so that the rate of cooling provided within the Stage I air quench 114 of the quench system 200 can be adjustable to accommodate various types of castings with different quenching profiles.

After passing through the first section 210, the castings can then enter a second section 220 having a liquid spray cooling system 222 that provides a Stage II spray quench 124 (FIG. 2). The liquid spray cooling system 222 can include rows of nozzles 224 with nozzle heads 226 that spray a cooling liquid, such as water or a water/glycol mixture, onto the hot castings during the intermediate Stage II portion of the quenching process.

Upon reaching the end of the second section 220, the castings can then pass into a third section 230 having another bulk air cooling system 232 that provides the Stage ill air quench 134 (FIG. 2). As with the first bulk air cooling system 212 proximate the entrance of the enclosure 202, the second bulk air cooling system 232 can also include one or more cooling fans 234, depending on the speed 201 at which the castings travel through the enclosure 202. The cooling fans 234 in the third section 230 of the quench system 200 can also be provided with VFD drives so that the rate of cooling provided within the Stage III air quench 134 may be adjustable.

Figure 3:
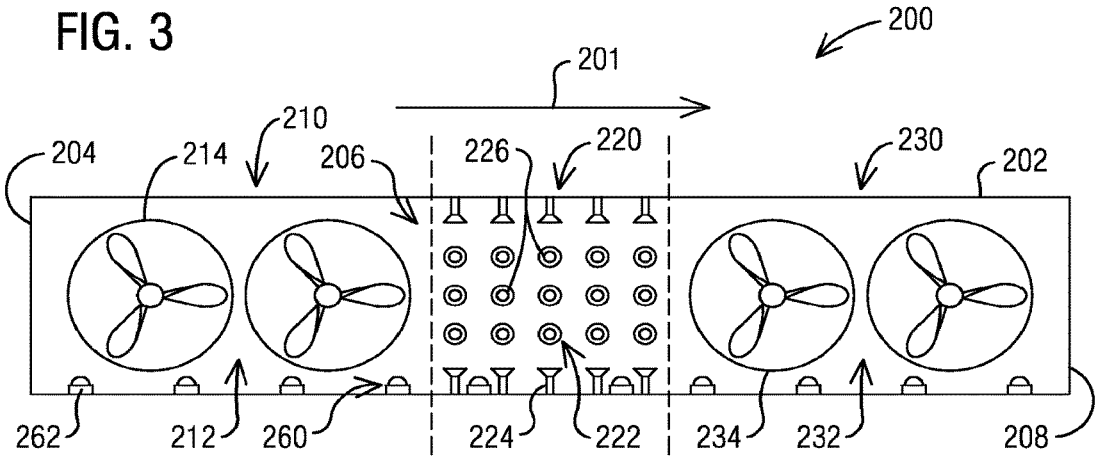
FIG. 3 is a schematic diagram of a multi-stage air/liquid quench system for cooling castings, in accordance with yet another representative embodiment.

Also shown in FIG. 3, the multi-stage quench system 200 can also include an optional temperature sensing system 260 that can measure the surface temperature of the castings through the use of a plurality of temperature sensors 262 that can be spaced along the length of the enclosure 202. In other aspects the one or more temperature sensors may be located directly on or within the casting part. Although not shown, it is understood that the temperature sensing system 260 can be in electrical communication with the programmable controller described above, which may be used to monitor and record the reduction in the surface temperature of the castings as they pass through the quench system 200.

Figure 4:
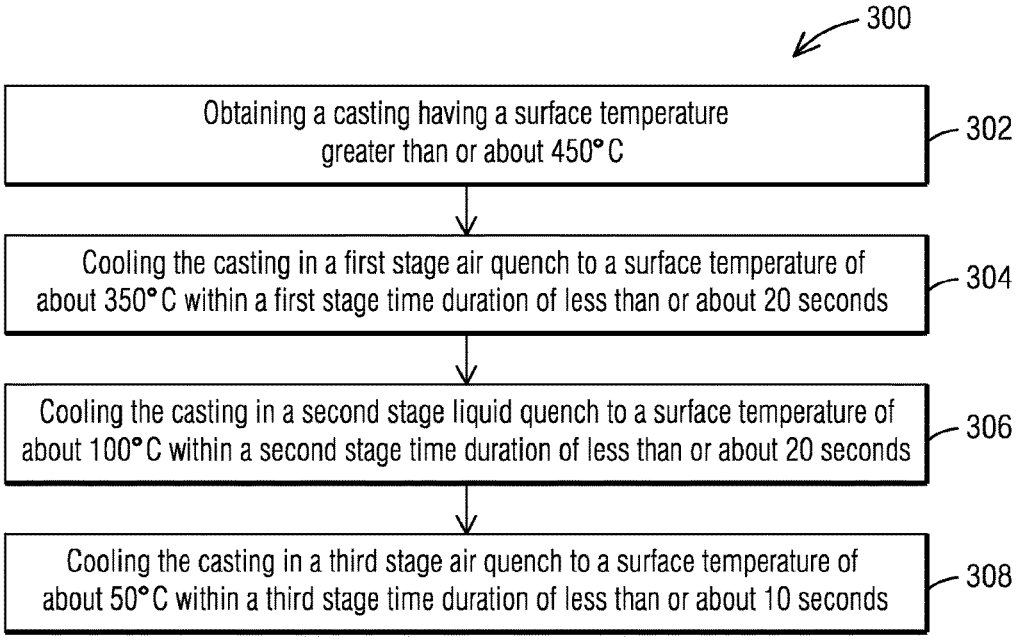
FIG. 4 is a flowchart depicting a multi-stage method for quenching a casting, in accordance with yet another representative embodiment.

FIG. 4 is a flowchart depicting another representative embodiment of the present disclosure comprising a multi-stage method 300 for quenching a hot casting that includes the steps of obtaining 302 a metallic casting having a surface temperature greater than or about 450° C., and cooling 304 the casting in a first stage bulk air quench to a surface temperature of about 350° C. within a first stage time duration of less than or about 20 seconds. The method also includes the steps of cooling 306 the casting in a second stage liquid spray quench to a surface temperature of about 100° C. within a second stage time duration of less than or about 20 seconds, followed by cooling the casting 308 in a third stage bulk air quench to a surface temperature of about 50° C. within a third stage time duration of less than or about 10 seconds.

Figure 5:
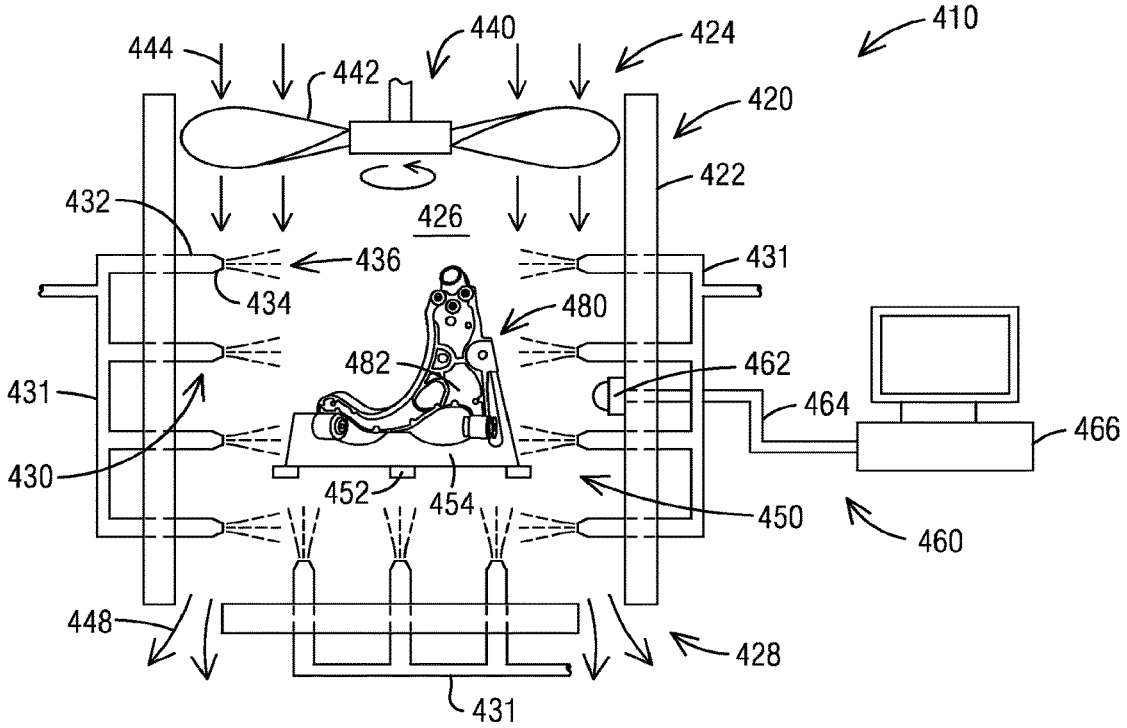
FIG. 5 is a schematic diagram of a multi-stage bulk air/directed air quench system for quenching castings, in accordance with a representative embodiment of the disclosure.

In another embodiment of the multi-stage quench system shown in FIG. 5, the bulk air cooling system 440 may remain substantially unchanged while the pressurized liquid spray cooling system can be replaced with a pressurized directed air cooling system 430. The directed air cooling system 430 can include a source of pressurized cooling air that is in fluid communication with a plurality of nozzles 432 and nozzle heads 434 through one or more manifolds 431. While the pressurized cooling air can generally comprise compressed air, in some aspects, the directed air can instead comprise another gaseous component, such as argon, or a mixture of one or more of air and additional gaseous components, such as a mixture of air and argon. Similar to the liquid spray cooling system described above, the nozzles 432 and nozzle heads 434 of the directed air cooling system 430 can be configured or positioned to provide the directed air in a plurality of high velocity streams 436 that can be narrowly focused, so that the directed flows 436 impinge against particular regions of the hot casting 480 during one or more portions of the quench cycle. In addition, the temperature of the pressurized cooling air prior to dispersal from the nozzles may be maintained at a predetermined temperature that has been optimized to provide the desired cooling affects.

As with the embodiment of the quench system illustrated in FIG. 1, the casting 480 of FIG. 5 represents a control arm 482 that has been formed from an aluminum alloy material through a high pressure die cast (HPDC) process. It is to be appreciated, however, that the casting 480 can be made from a wide variety of casting materials, including various aluminum alloys (being equal to or greater than 50% aluminum by weight) and non-aluminum alloys (being less than 50% aluminum by weight), and that the casting 480 can be made through a variety of casting processes other than the HPDC process. It is also understood that the control arm 482 is merely a representative casting 480 for discussion purposes, that the casting can also be shaped into a variety of parts for a range of industries, and that in some aspects the casting 480 can include both thick-wall portions that provide the part with its required rigidity and strength and thin-wall portions that serve to reduce the overall weight or material cost of the part without a substantial decrease in performance.

In addition, the hot casting 480 can be removably positioned or secured within the quench chamber 426 using a support system 450 that positions and orients the casting 480 during the quenching process. In one aspect the support system 450 can comprise a framework or fixture 454 that extends upward from a tray 452 to contact the casting at a few locations across its bottom surfaces and/or lower edges so as to loosely maintain the casting at a desired position and orientation within the quench chamber 426, but with both the fixture 454 and tray 452 otherwise being largely open or empty so to not block the flows of the various cooling fluids from reaching the casting.

The nozzles 432 and nozzle heads 434 of the pressurized directed air cooling system 430 can be configurable in both direction and flow so as to provide precision control over the application of directed air 436 onto the hot casting 480. For example, the configuration of individual nozzles 432 and nozzle heads 434 may be customizable, either manually or by programmable actuation, to match a particular casting part, so as to increase the volume and/or velocity of the streams 436 of directed air that are applied to the thicker portions of the casting 80 relative to the volume/velocity of directed air that is applied to the thin-wall portions of the casting. In addition, the directed air 436 can be simultaneously applied to all sides or exposed surfaces of the casting 480 (i.e. front, back, sides, bottom, top, or internally). In this way the casting 480 may be cooled in a substantially uniform manner throughout the directed air cooling portion(s) of the quenching cycle. Thus the relative temperatures of the various portions of the casting 480 can be maintained substantially equal throughout the quenching cycle, with the intended result that thermally-induced internal stresses and the resulting dimension distortions of the casting 480 may be substantially reduced.

The bulk air cooling system 440 can include one or more rotatable fans 442 that are configured to provide a bulk stream of low velocity cooling air 444 that enters the chamber 426 of the housing 420 through an entrance 424 in the enclosure 422, passes across and around exterior surfaces of the hot casting 480 to remove heat from the casting, and then exits the chamber 426 through one or more exits 428 as an exhaust flow 448. In one aspect the temperature and flow rate of the cooling air 444 can be controlled to provide the desired cooling characteristics. For instance, the rotatable cooling fans 442 can be powered by variable frequency drives (VFDs) that provide a continuously variable bulk flow of cooling air 444 across a wide range of operating speeds or frequencies. In addition, the bulk air cooling system 440 and the chamber 426 may be configured to ensure that the cooling air 444 passes over substantially all of the exposed exterior surfaces of the casting 480 to cool the casting in a substantially uniform manner throughout the bulk air cooling portion(s) of the quenching cycle.

As understood by one of skill in the art, moreover, the configuration of the bulk air cooling system 440 depicted in FIG. 5 is merely illustrative of a generalized bulk air system that provides for a broadly-distributed stream of cooling air 444 that generally flows at a lower velocity than the high velocity cooling air streams 436 from the directed air cooling system 430. For example, the fan 442 could be positioned above or below the chamber 426 or even remote from the chamber, and configured to draw or push the cooling air through the chamber and across the casting 40 from any direction. Indeed, it may be advantageous to draw the cooling air 444 into the chamber from below and discharge the exhaust air 448 through exits located in the upper portion of the chamber 426, in a direction opposite from that illustrated in FIG. 5.

The multi-stage quench system 410 also generally includes a programmable controller 466, such as a computer or similar electronic processor-based device, that is configured to activate and deactivate the bulk air cooling system 440 and the pressurized directed air cooling system 430. Thus, the controller 466 can be used to adjust the cooling provided by the directed air cooling system 430 and the bulk air cooling system 440 to ensure that each type of casting 480 can experience a specific, pre-programmed quenching process. In one aspect the controller 466 can also be used to automatically adjust the positioning and flow of cooling air through individual nozzles 432, as described above. Alternatively, the quench system 410 may utilize a basic timer system wherein a set defined time schedule is used for sequentially activating and deactivating each of the cooling systems 430, 440.

Also shown in FIG. 5 is the optional temperature sensing system 460 that can measure and monitor the surface temperature of the casting 480 through the use of one or more temperature sensors 462. In one aspect the temperature sensors 462 can remotely measure the surface temperature of the casting 480 at one or more locations without contacting the surface, such as with an infrared sensor. In other aspects the one or more temperature sensors may be located directly on or within the casting part. Electrical communication can be established between the temperature sensors 462 and the programmable controller 466 through control wiring 464, with the programmable controller 466 being used to monitor and record the reduction in the surface temperature of the casting 480 as it undergoes the quenching process.

Similar to the three stage air/liquid embodiment of the multi-stage quench system 10 described above, once the hot casting 480 has been positioned or secured within the quench chamber 426 of the multi-stage quench system 410 illustrated in FIG. 5, the bulk air cooling system and the directed air cooling system can be operated independently, or together, to rapidly quench the casting using a predetermined sequence of quenching stages or steps. One method of utilizing the multi-stage quench system 410 is expressed below, as might be applied to an aluminum alloy casting. For example, the temperature vs. time graph of a representative process 500 for quenching the aluminum alloy casting 480 is provided in FIG. 6 (also known as a quench profile), in which the temperature 502 of the casting can be quickly reduced in three distinct stages. The stages can include alternating operation of the bulk air cooling system and the directed air cooling system. However, it will be appreciated that the stages could also include any sequence of bulk air cooling and directed air cooling and could include more or less than three distinct stages. By reducing the temperature 502 of the casting rapidly yet in a controlled manner, the quench system described herein results in a high strength part with minimal dimensional distortions.

Prior to entering the first stage ("Stage I") 510 of the quenching process 500, the hot casting can be placed into the quench system 410 at an initial temperature 512. For aluminum-base alloys, for example, the initial temperature 512 can range from about 450° C. to about 650° C., and in one representative embodiment (FIG. 3) can be about 500° C. The bulk air cooling system 440 can then be activated to provide a Stage I bulk air quench 514 that cools the casting from the initial temperature 512 to a first intermediate temperature 522. Depending on the casting alloy and/or the thickness of the casting, the first intermediate temperature 522 can range from about 275° C. to about 450° C., and in the embodiment of FIG. 6 can be about 350° C. The Stage I 510 bulk air quench 514 takes place during a Stage I time period 516 lasting between about 20 seconds and about 50 seconds. This can result in a Stage I cooling rate 518 ranging between about 20° C./see and about 3° C./sec. In some aspects the Stage I cooling rate 518 can be substantially linear or constant, while in other aspects the Stage I cooling rate 518 may be non-linear or variable.

At the conclusion of the first stage 510 of the quenching process 500, the bulk air cooling system 440 can be deactivated and the directed air cooling system 430 activated to provide a second stage ("Stage II") 520 directed air quench 524 that further cools the casting from the first intermediate temperature 522 to a second intermediate temperature 532. The second intermediate temperature 532 can range from about 100° C. to about 175° C. and in the embodiment of FIG. 6 can be about 150° C. The Stage II 520 directed air quench 524 can have a time period 526 lasting between about 20 seconds and about 40 seconds, resulting in a Stage II cooling rate 528 ranging between about 20° C./sec and about 3° C./sec. In some aspects the Stage II cooling rate 528 can be substantially constant, while in other aspects the Stage II cooling rate 528 may be variable.

Figure 6:
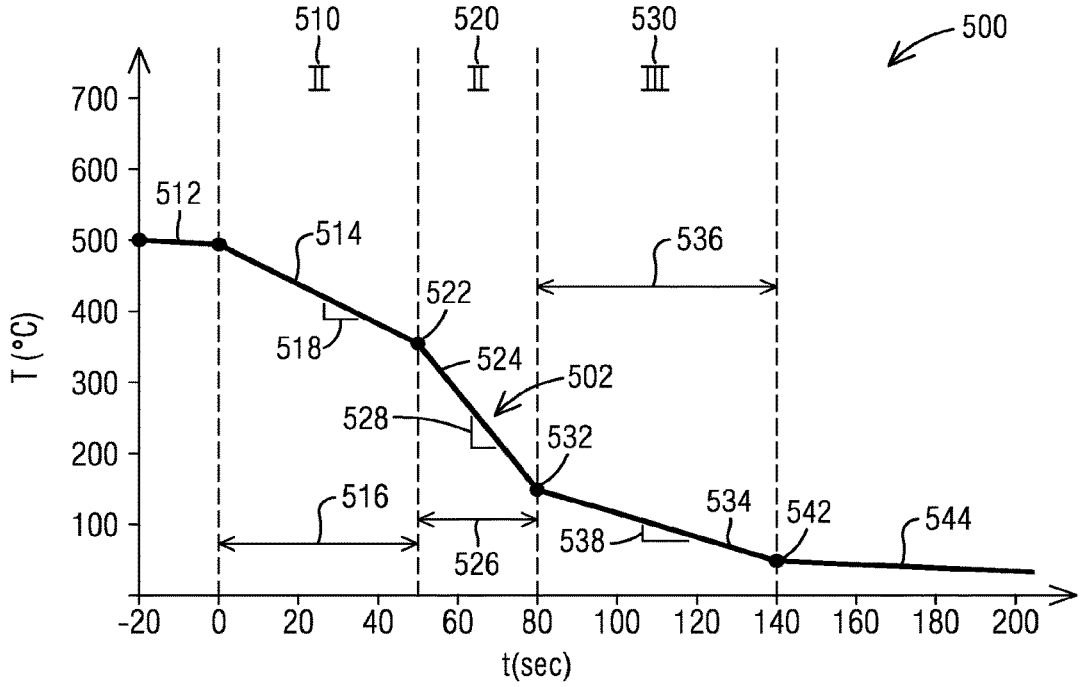
FIG. 6 is a graph representing the temperature change of a casting throughout a multi-stage quenching process, in accordance with another representative embodiment.

After the casting temperature has reached the second intermediate temperature 532, in one aspect the directed air cooling system 430 can be adjusted such that the flow of air through the manifolds is decreased to provide a third stage ("Stage III") 530 directed air quench 534 that further cools the casting from the second intermediate temperature 532 to a final quench temperature 542 of about 70° C. or lower. In the embodiment of FIG. 6, the final quench temperature 542 can be about 50° C. The Stage III 530 directed air quench 534 can have a time period 536 of less than or about 60 seconds, resulting in a Stage III cooling rate 538 between about 3.5° C./sec and about 0.5° C./sec. In some aspects the Stage III cooling rate 538 can be substantially constant, while in other aspects the Stage III cooling rate 538 may be variable. After reaching the final quench temperature 542 of about 50° C., the casting can be allowed to gradually cool 544 to ambient temperature for natural aging, or may be transferred to a secondary furnace for artificial aging at an elevated temperature. In an alternative embodiment (not shown), the directed air cooling system 430 can be deactivated after completion of Stage II 520 of the quenching process 500 and the bulk air cooling system 440 reactivated to provide a bulk air quench during Stage II 530.

As discussed above, each of the bulk air quench stage 514 and the directed air quench stages 524, 534 can be configured to cool the casting in a substantially uniform manner throughout the quench steps to reduce the thermally-induced stresses that may develop within the part. This feature of the disclosure can function to minimize or substantially reduce the thermally-induced dimensional distortions that may otherwise be generated during the quenching processes, resulting in fewer castings that are rejected for falling outside of dimensional tolerances. In some embodiments the uniform quenching process may be combined with a support system 450 (FIG. 5) that includes close-tolerance bracing (not shown but known in the art) to further constrain the casting during quenching in a manner that resists any thermally-induced distortions.

The total time to perform the multi-stage quenching process 500 on a hot aluminum alloy casting, from the initial temperature 522 to the final quench temperature 542, can range from about 60 seconds to about 150 seconds. In some embodiments, the additional time to move the casting into and out of the quench system 410 is less than about 30 seconds, for a total sequence time that can range from about 90 to about 180 seconds. Although the multi-stage quenching process 500 of FIG. 6 can take longer than an immediate immersion quench in water or oil, as presently available in the art, the ability to variably control the cooling rate of the casting throughout the multi-stage quenching process can result in a quenched casting with improved metallurgical properties and reduced dimensional distortions. In some aspects, moreover, it is contemplated that the multi-stage quenching process 500, when used to conclude a properly-optimized solution heat treatment process, can provide the resulting casting with such improved metallurgical properties that the additional step of artificially aging the casting at an elevated temperature in a secondary furnace may not be necessary.

It will be appreciated that both the air/liquid embodiments of the multi-stage quench system 10 illustrated in FIGS. 1-2 and the bulk air/directed air embodiments of the multi-stage quench system 410 illustrated in FIGS. 5-6 can have application as original or OEM systems for quenching metallic castings. However, it is also possible or even likely that the multi-stage quench systems 10, 410 can also be used to retrofit existing metallic casting quench systems. In particular, the bulk air/directed air quench system 410 can be easy to add to existing metallic casting air quench systems that do not utilize water in the quenching process. For example, representative retrofit bulk air/directed air quench systems 610, 611, such as those illustrated in FIGS. 7A-7B, may be used to improve an existing air quench system, without requiring replacement of the existing system, through the addition of a directed air cooling system 630 and related components. Such existing systems will also generally include a housing 620 comprising an enclosure 622 that surrounds a chamber 626 within which a hot casting 680 can be positioned or secured.

Figure 7A:
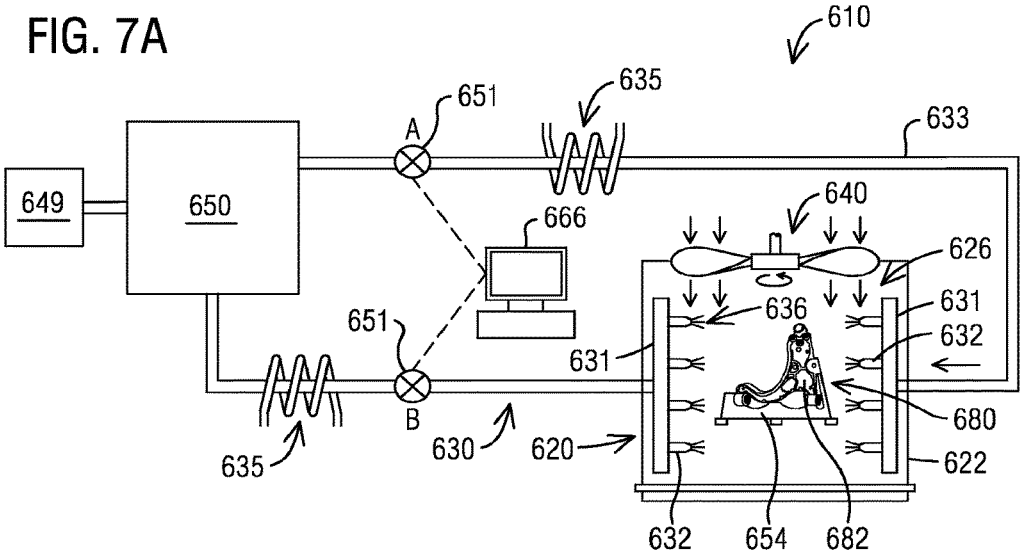
FIG. 7A is a schematic diagram of a multi-stage bulk air/directed air quench system for quenching castings, in accordance with another representative embodiment of the disclosure.
Figure 7B:
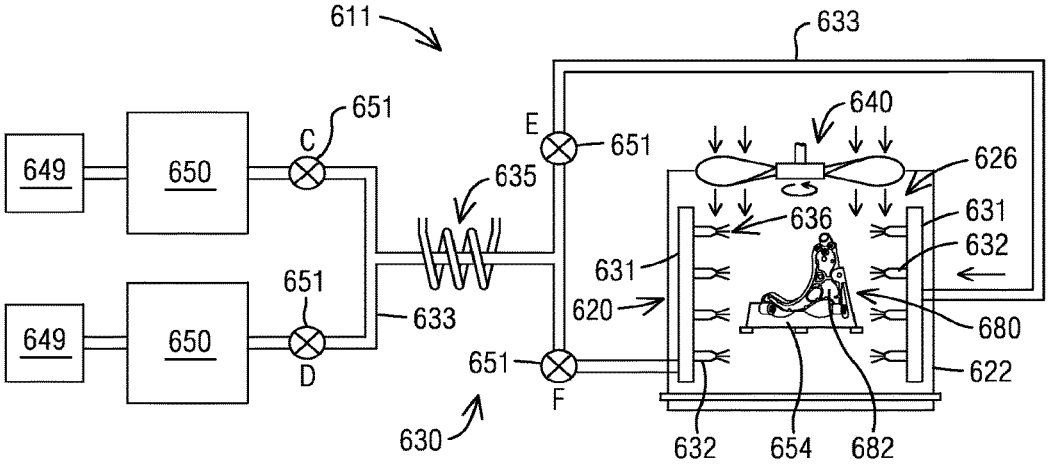
FIG. 7B is a schematic diagram of a multi-stage bulk air/directed air quench system for quenching castings, in accordance with yet another representative embodiment of the disclosure.

The quench systems 610, 611 shown in FIGS. 7A-7B generally include an improved or modified bulk air cooling system 640 and a new directed air cooling system 630. The directed air cooling system 630 generally has a plurality of manifolds 631, with each manifold including a plurality of nozzles 632 with nozzle heads 634 that direct a high velocity stream of cooling air 636 onto the hot casting 680 during one or more portions of the quench cycle. The manifolds 631 may have various configurations of nozzles, including different numbers of nozzles, differently directed nozzles, or different spacings between nozzles. In one aspect, for instance, the manifolds 631 can be interchangeable and may be swapped with a different manifold 631 or removed from the enclosure 622. By using a particular set of interchangeable manifolds 631 that correspond to a particular casting 680, the quench system 610 may be configured to direct air during a quench cycle to optimize desired properties for a particular part or casting 680. In another aspect the manifolds 631 include individually re-configurable nozzles 632 that can be modified for use with different types or models castings 680 without changing manifolds, but rather by manipulating individual nozzles 632 and nozzle heads 634 either manually or with powered actuators via a pre-programmed sequence.

The nozzles 632 are adapted to direct pressurized air that is supplied through the manifolds 631 via a piping system 633 from one or more pressurized holding tanks 650, with each pressure holding tank 650 being filled by one or more air compressors 649. In addition, a plurality of control valves or automated regulators 651 can be used to control or regulate the flow of air from the pressurized holding tank 650 to the one or more manifolds 631. The regulators 651 and the pressurized holding tank 650 may be located remotely from the manifolds 631, and may be controlled by an electronic processor-based device 666 that can operate both the automated regulators 651 to control the cooling provided by the directed air cooling system 630 and the bulk air cooling system 640 to ensure that the casting 680 experiences a specific, pre-programmed quenching process. Each regulator 651 may correspond to and control the flow to a particular manifold 631, or the regulators 651 may cooperate to control the overall flow to a combination of some or all the manifolds 631. In addition, in some embodiments heat exchangers 635 can be included within the piping system 633 to chill the pressurized air as it travels from the holding tanks 650 to the manifolds 631 and nozzles 632.

In addition, in some aspects the retrofit quench systems 610, 611 can also be modified to include removable trays with open-type fixtures 654 that loosely support the castings at a desired position and orientation within the quench chamber 626, with both the fixtures 654 and trays being largely open or empty so as to not block the flows of the various high-velocity streams of cooling air from the nozzles 632 from reaching the castings.

In one representative embodiment shown schematically in FIG. 7A, the multi-stage quench system 610 can include two automated regulators 651, regulator A and regulator B. The automated regulators 651 may cooperate in a variety of ways to control the flow of directed air 636 through the piping system 633 and manifolds 631 such that the automated regulators 651 can vary the flow rate of directed air 636 for faster or slower directed quenching. For instance, one of regulator A and regulator B may be open during some stages of the quench, the other of regulator A and regulator B may be open during some stages of the quench, or both regulator A and regulator B may be open during some stages of the quench. Alternatively, regulators A and B can be fully open during some stages of the directed air quenches and partially closed during other stages of the directed air quench. In addition, in embodiments where a sand mold is used to form the metallic casting, the regulators 651 may also cooperate with particular nozzles 632 to focus the flow of directed cooling air 636 to remove internal and/or external residual sand from the casting.

In another representative embodiment of the multi-stage quench air system 611 shown schematically in FIG. 7B, two separate sets of air compressors 649 and pressurized holding tanks 650 can be networked together through a piping system 633 having at least four automated regulators 651 (C, D, E, F) that can be configured to separately cycle the flow of cooling air 636 from each holding tank 650 to the plurality of manifolds 631 and nozzles 632. In this way one of the holding tanks can be drawn down while quenching the castings 680 within the quench chamber while the other holding tank is closed off for re-filling with compressed air from air compressor 649, to be used for the next batch of castings. In one aspect each of the two air compressors 649 can be sized to move about 15,000-20,000 cubic feet per minute (CFM) of air or gas, at about 50 horsepower, which can be sufficient to re-fill a depleted pressurized holding tank 650 in less than about 3 minutes. Nevertheless, it will appreciated that a higher or lower horsepower air compressor 649 could be used, as well as more than one air compressors per holding tank 650, and that the flow rate from each compressor could be higher or lower than 15,000-20,000 CFM without departing from the scope of this disclosure.

It will be appreciated that the examples shown in FIGS. 7A-7B are exemplary only, and that the automated regulators 651 could be otherwise configured without departing from the scope of this disclosure. For example, more or less automated regulators 651 could be used in a variety of combinations or configurations to control the flow and pressure of the cooling air 636 from the holding tanks 620 to the nozzles 632.

As with the air/liquid embodiments of the multi-stage quench system 10 and quenching process 100 illustrated above in FIGS. 1-2, the bulk air/directed air embodiments of the multi-stage quench system 410 and quenching process 500 illustrated in FIGS. 5-6 can be a batch-based or cell-based quench system in which each stage of the quenching process is performed at the same location on a casting 480 that can be substantially fixed in space, or at least within the chamber 426 of the enclosure 420. Nevertheless, it is also possible or even likely that mass produced castings will undergo the multi-stage quenching process 500 while moving through a continuous process quench system such as, for example, the multi-stage quench system 700 illustrated in FIG. 8.

The multi-stage quench system 700 generally includes an elongated enclosure 702 that defines a quench chamber 706, with multiple castings (not shown) traveling through the chamber 706 at a substantially constant speed 701 from an entrance opening 704 at one end of the enclosure 702 to an exit opening 708 at the opposite end. The enclosure 702 generally includes a first section 710 having a bulk air cooling system 712 that provides a Stage I air quench 514 (FIG. 6). Depending on the speed 701 at which the castings travel through the enclosure 702, the bulk air cooling system 712 may include one or more cooling fans 714 that provide a bulk flow of cooling air through the chamber 706. In one aspect the cooling fans 714 can be provided with VFD drives so that bulk flow of cooling air is continuously variable across a wide range of operating speeds, so that the rate of cooling provided within the Stage I air quench 514 of the quench system 700 can be adjustable to accommodate various types of castings with different quenching profiles.

After passing through the first section 710, the castings can then enter a second section 720 having a directed air quench system 722 that provides a Stage II directed air quench 524 (FIG. 6). The directed air quench system 722 can include rows of nozzles 724 extending inward from a plurality of manifolds 726 that are supplied by a pressurized air piping system 728, with each of the nozzles 724 including nozzle heads that direct cooling air onto the hot castings during the Stage II portion of the quenching process.

Upon reaching the end of the second section 720, the castings can then pass into a third section 730. The third section 730 can have another directed air quench system 732 that provides the Stage III directed air quench 530 (FIG. 6). As with the Stage II directed air quench system 722, the second directed air quench system 732 can include rows of nozzles 734 extending inward from a plurality of manifolds 736 that are supplied by a pressurized air piping system 738, with each of the nozzles 734 including nozzle heads that direct cooling air onto the hot castings during the Stage II portion of the quenching process.

Figure 8:
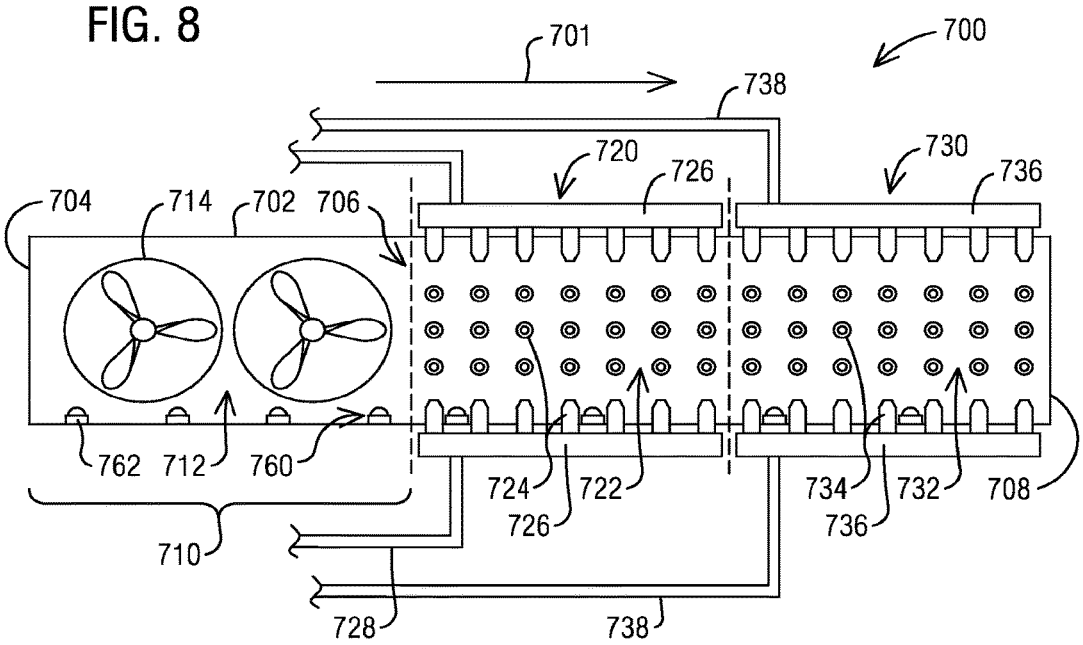
FIG. 8 is a schematic diagram of a multi-stage bulk air/directed air quench system for quenching castings, in accordance with yet another representative embodiment of the disclosure.

Also shown in FIG. 8, the multi-stage quench system 700 can also include an optional temperature sensing system 760 that can measure the surface temperature of the castings through the use of a plurality of temperature sensors 762 that can be spaced along the length of the enclosure 702. In other aspects the one or more temperature sensors may be located directly on or within the casting part. Although not shown, it is understood that the temperature sensing system 760 can be in electrical communication with the programmable controller described above, which may be used to monitor and record the reduction in the surface temperature of the castings as they pass through the quench system 700.

Figure 9:
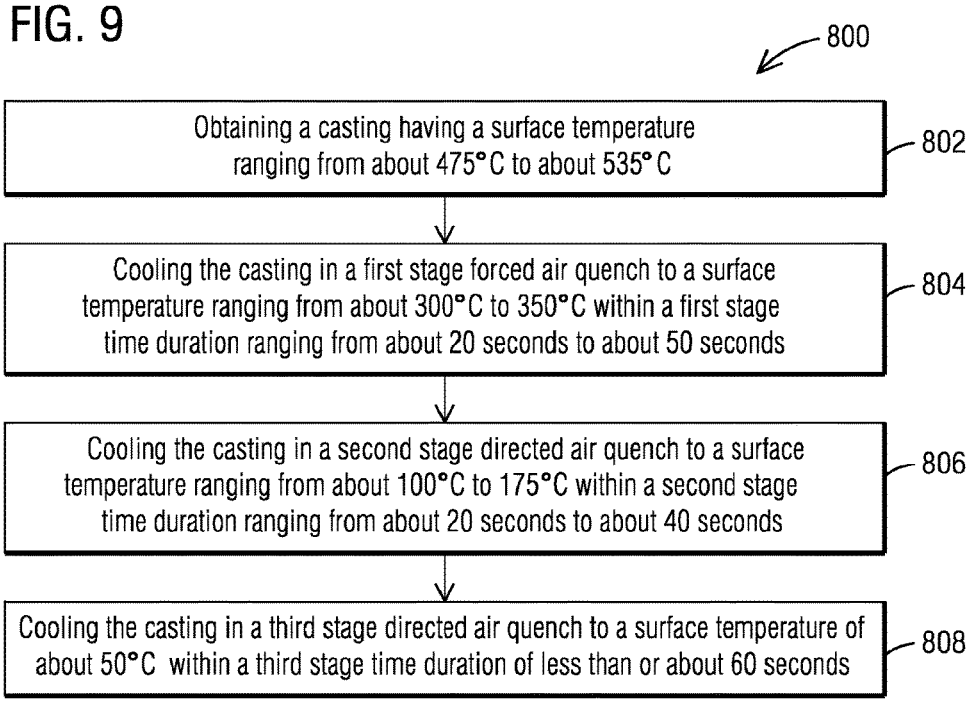
FIG. 9 is a flowchart depicting a multi-stage method for quenching a casting, in accordance with yet another representative embodiment.

In yet another embodiment of the present disclosure, FIG. 9 is a flowchart depicting a method 800 for quenching a hot casting that includes the steps of obtaining 802 a metallic casting having a surface or internal temperature that can range from about 475° C. to about 535° C., and cooling 804 the casting in a first stage bulk air quench to a surface or internal temperature ranging from about 300° C. to about 350° C. within a first stage time duration of ranging from about 20 to about 50 seconds. The method also includes the steps of cooling 806 the casting in a second stage directed air quench to a surface temperature ranging from about 100° C. to about 175° C. within a second stage time duration ranging from about 20 to about 40 seconds, and followed by cooling the casting 808 in a third stage directed air quench to a surface temperature of about 50° C. within a third stage time duration of less than or about 60 seconds.

The invention has been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments without departing from the spirit and scope of the invention. These and other revisions might be made by those of skill in the art without departing from the spirit and scope of the invention that is constrained only by the following claims.

The invention claimed is:

1. A quench system for cooling a hot casting through a quenching cycle, the quench system comprising:

an enclosure defining a quench chamber for receiving at least one casting in a heated state, the enclosure including a bulk air inlet for communicating bulk air flow from a source of cooling air outside the quench chamber into the quench chamber and a bulk air exit for communicating bulk air flow out of the quench chamber, wherein the enclosure defines a bulk air flow path by which air may enter the quench chamber through the bulk air inlet, pass through the quench chamber, including through locations in the quench chamber where a casting may be positioned, and exit the chamber through the bulk air exit;

at least one bulk air fan in fluid communication with the quench chamber and configured to establish a bulk flow of cooling air through the bulk air flow path, whereby a bulk flow of cooling air may surround a casting positioned in the quench chamber; and a pressurizable cooling system in fluid communication with a plurality of nozzles within the quench chamber and configured to spray a plurality of directed flows of cooling fluid.

2. The quench system of claim 1, wherein the pressurizable cooling system includes a source of pressurized cooling fluid in fluid communication with the plurality of nozzles.

3. The quench system of claim 2, wherein the directed flows of water further comprise directed flows of atomized water droplets.

4. The quench system of claim 2, wherein the source of pressurized cooling fluid comprises a source of water.

5. The quench system of claim 2, wherein the source of pressurized cooling fluid comprises a source of air.

6. The quench system of claim 5, wherein the nozzles of the plurality of nozzles of the pressurizable cooling system are configurable to spray air from at least one of the nozzles at a volume or a velocity that is higher than the volume or velocity, respectively, sprayed simultaneously from at least one other of the nozzles.

7. The quench system of claim 5, wherein the pressurized cooling system includes a source of argon.

8. The quench system of claim 1, further comprising a programmable controller configured to sequentially activate the at least one bulk air fan to cool a casting at a first cooling rate for a first predetermined period of time, and then activate the pressurizable cooling system to cool the casting at a second cooling rate for a second predetermined period of time.

9. The quench system of claim 1, wherein a motor driving the at least one bulk air fan is powered by a variable frequency drive (VFD).

10. The quench system of claim 1, wherein the enclosure further comprises a conveyance apparatus defining a conveyance path through the chamber; and wherein the plurality of nozzles is positioned downstream of the at least one bulk air fan.

11. The quench system of claim 10, further comprising a second bulk air fan in fluid communication with the quench chamber and downstream of the plurality of nozzles.

12. The quench system of claim 10, further comprising a second plurality of nozzles within the quench chamber and downstream of the plurality of nozzles.

13. A quench system for cooling a hot casting through a quenching cycle, the quench system comprising:

an enclosure defining a quench chamber for receiving at least one casting in a heated state;

at least one bulk air fan in fluid communication with the quench chamber;

a pressurizable cooling system in fluid communication with a plurality of nozzles within the quench chamber; and a programmable controller configured to sequentially activate the at least one bulk air fan to cool a casting in the quench chamber at a first cooling rate for a first predetermined period of time, and then activate the pressurizable cooling system to cool the casting in the quench chamber at a second cooling rate for a second predetermined period of time.

14. The quench system of claim 13, wherein the at least one bulk air fan is configured to establish a bulk flow of cooling air that surrounds a casting in the quench chamber to extract heat from the casting at the first cooling rate; and wherein the pressurizable cooling system is configured to spray a plurality of directed flows of cooling fluid onto a casting in the quench chamber to extract heat from the casting at a second cooling rate.

15. A quench system for cooling a hot casting through a quenching cycle, the quench system comprising:

an enclosure defining a quench chamber for receiving at least one casting in a heated state;

at least one bulk air fan in fluid communication with the quench chamber, wherein a motor driving the at least one bulk air fan is powered by a variable frequency drive (VFD); and a pressurizable cooling system in fluid communication with a plurality of nozzles within the quench chamber.

16. The quench system of claim 15, wherein the pressurized cooling system includes a source of glycol.

17. The quench system of claim 15, wherein the at least one bulk air fan is configured to establish a bulk flow of cooling air that surrounds a casting in the quench chamber to extract heat from the casting at the first cooling rate; and wherein the pressurizable cooling system is configured to spray a plurality of directed flows of cooling fluid onto a casting in the quench chamber to extract heat from the casting at a second cooling rate.

* * * * *